US006475107B1

(12) United States Patent
Sand

(10) Patent No.: US 6,475,107 B1
(45) Date of Patent: Nov. 5, 2002

(54) GOLF TEE HEIGHT SET APPARATUS

(76) Inventor: Darrel R. Sand, 1670 Boulevard Dr., Okemos, MI (US) 48840

( * ) Notice: Subject to any disclaimer, the term of this patent is extended or adjusted under 35 U.S.C. 154(b) by 0 days.

(21) Appl. No.: 09/571,310

(22) Filed: May 12, 2000

Related U.S. Application Data

(60) Provisional application No. 60/134,101, filed on May 14, 1999.

(51) Int. Cl.[7] ..... L63B 57/00
(52) U.S. Cl. ..... 473/398; 473/400
(58) Field of Search ..... 473/387–403; D21/717, 718

(56) References Cited

U.S. PATENT DOCUMENTS

| | | | | | |
|---|---|---|---|---|---|
| 1,553,561 | A | * | 9/1925 | Scott | 473/400 |
| 1,625,911 | A | * | 4/1927 | Richards | 273/398 |
| 1,638,448 | A | * | 8/1927 | Manson | 473/394 |
| 2,700,788 | A | * | 2/1955 | Hennelly | 16/86 |
| 3,079,158 | A | * | 2/1963 | Finn et al. | 473/396 |
| 3,114,557 | A | * | 12/1963 | Cabot | 473/398 |
| 3,203,700 | A | * | 8/1965 | Antonious | 473/398 |
| 3,408,079 | A | * | 10/1968 | Kirikos | 473/398 |
| 3,606,344 | A | * | 9/1971 | Ball | 473/398 |
| 3,671,036 | A | * | 6/1972 | Rubino | 473/386 |
| 3,883,144 | A | * | 5/1975 | Lazow | 473/398 |
| 4,989,868 | A | * | 2/1991 | Manko | 473/386 |
| 5,052,689 | A | * | 10/1991 | Lettrich | 473/386 |
| 5,242,161 | A | * | 9/1993 | Wilkirson | 473/386 |
| D360,006 | S | * | 7/1995 | Samples | D21/718 |
| 5,634,862 | A | * | 6/1997 | Gamache | 473/386 |
| 5,672,122 | A | * | 9/1997 | Strong | 473/398 |

FOREIGN PATENT DOCUMENTS

| | | | | |
|---|---|---|---|---|
| GB | 1387814 | * | 3/1975 | 273/33 |

* cited by examiner

*Primary Examiner*—Steven Wong
(74) *Attorney, Agent, or Firm*—Young & Basile, P.C.

(57) ABSTRACT

A golf tee height set apparatus includes a golf tee with a shank having a lower end extending between a pointed tip and a shoulder intermediate the opposite ends of the shank. The shoulder defines a surface extending radially outward from the lower end of the shank. The upper end increases in diameter from the shoulder to a ball receiving surface. A stopper in the form of a disc is slidable over the lower end of the shank into engagement with the shoulder. The stopper has an outer dimension suitable for resisting insertion of the tee into the ground beyond the stopper thereby setting a constantly repeatable height of the ball receiving surface of the golf tee above the ground. A plurality of like tees, each with a different dimension of the lower end or the upper end may be provided as a group of tees to provide repeatability for different tee shots.

6 Claims, 1 Drawing Sheet

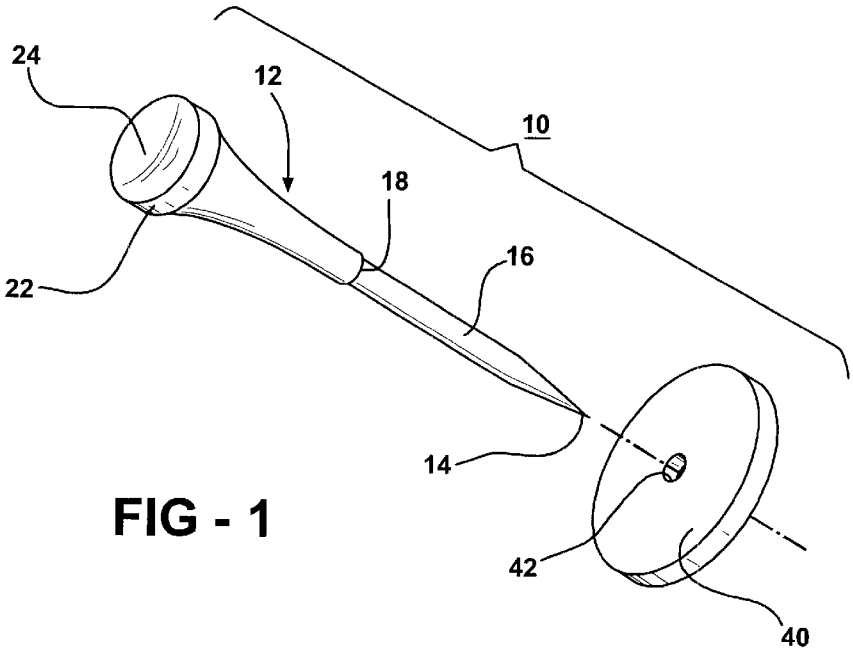
FIG - 1
FIG - 2
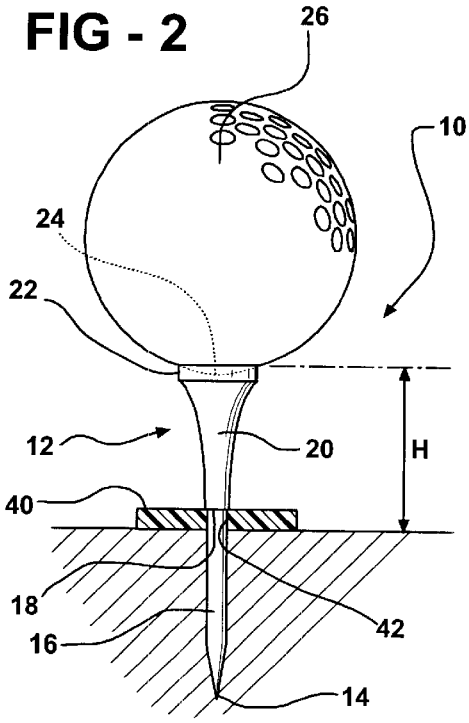
FIG - 3
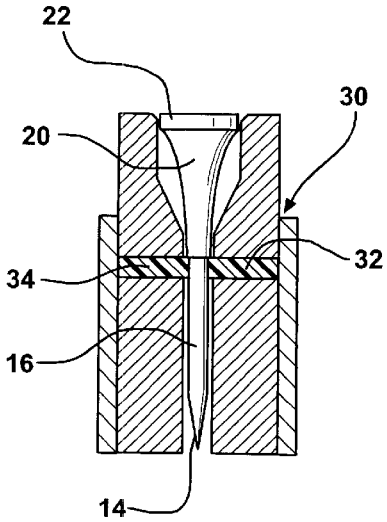

GOLF TEE HEIGHT SET APPARATUS

CROSS REFERENCE TO CO-PENDING APPLICATION

This Application claims the benefit of the filing date of U.S. Provisional Patent Application Ser. No. 60/134,101 filed May 14, 1999, the entire contents of which are incorporated herein by reference.

BACKGROUND OF THE INVENTION

1. Field of the Invention

The present invention relates, in general, to golf tees and, more specifically, to devices which enable the height of the top end of a golf tee to be repeatedly set above the ground.

2. Description of the Art

In golf, the rules enable a golfer to start every hole with a tee to position the ball above the ground. Typically, golf tees are made of wood or plastic and have a shaft which extends along a substantially constant diameter cross section for a predetermined distance from a pointed end insertable into the ground and then smoothly flares outwardly to an enlarged cup on which the ball is seated.

The height of the golf ball above ground is determined by the distance or depth that the pointed end of the tee is inserted into the ground. The ball height above the ground, depending upon the player's action during a golf swing, plays a part in the flight path and distance that the ball will travel when hit. If the height is wrong, i.e., too high above the ground, the ball will go very high but not very far down the fairway. If the ball height is too low, the ball will not achieve optimal vertical height and it will not, therefore, travel very far horizontally down the fairway.

The height of the ball above the ground on each tee shot will vary from golfer to golfer based on an individual's swing. However, a uniform height on each swing is important if the club face is to meet the ball at the same angle each time.

Further, a golfer may prefer the same height for all clubs or one height for the driver and a shorter height for a three wood. An iron may require even a shorter height ball position.

It is known to provide golf tee adjustment devices which enable the height of the top or cup end of the golf tee to be adjustably set by a golfer. However, such devices typically have complex shapes which therefore have a higher cost and may be difficult to easily use.

Thus, it would be desirable to provide a golf tee height setting apparatus which ensures a repeatable, identical ball height for each tee shot. It would also be desirable to provide a golf tee height setting device which is small in overall size for easy storage between uses. It would also be desirable to provide a golf tee height setting apparatus which can be easily attached to a golf tee.

SUMMARY OF THE INVENTION

The present invention is a golf tee height set apparatus which insures a constantly repeatable height of the ball receiving surface of the golf tee above the ground before each successive tee shot. In one aspect, the golf tee height set apparatus includes a golf tee having a shank with a pointed tip at one end, and an upper end extending from an intermediate shoulder as the shank to a golf ball receiving surface.

A stopper having an aperture sized to fit over the shank is disposed in engagement with the shoulder. The stopper has an outer edge projecting radially outward from the shoulder to engage the ground when the pointed tip is inserted into the ground to repeatedly set a constant height for the ball receiving surface of the golf tee above the ground.

In one aspect, the stopper is a planar member having an aperture of a diameter greater than the diameter of the portion of the shank between the pointed tip and the shoulder and a smaller diameter then the shoulder. The outer edge of the stopper extends radially outward beyond the diameter of the ball receiving surface of the shank to prevent insertion of the golf tee completely into the ground beyond the stopper. In one aspect, the stopper is an annular disc.

In one perferred aspect, the shank has a constant diameter between the pointed tip and the shoulder, and a varying enlarging diameter from the shoulder to the ball receiving surface.

In another aspect, the shank has a lower portion formed between the pointed tip and the shoulder and an upper end and the ball receiving surface. A plurality of like tees form a group, with each of the tees in the group having a different length lower end or upper end.

The golf tee height set apparatus of the present invention provides a constantly repeatable identical ball tee height for each golf tee shot. The apparatus is of simple construction and requires only a minor modification to existing golf tees. The stopper employed as part of the golf tee height set apparatus of the present invention is also small in size for convenient storage separate from a golf tee when not in use; while still being able to be easily mounted on a golf tee for the next tee shot. In addition, the present invention can be implemented in a group of similarly shaped golf tees having the dimensions of either the lower end between the pointed tip and the shoulder or the upper end between the shoulder and the ball receiving surface of the golf tee of varying incremental dimensions to provide a golfer with different repeatable heights depending upon the golf hole, the player's swing, etc. One or more stoppers may be provided with the group of like golf tees and both the tees and the stoppers may be provided with distinct identification, such as different colors, etc., to distinguish the various tee heights.

BRIEF DESCRIPTION OF THE DRAWING

The various features, advantages and other uses of the present invention will become more apparent by referring to the following detailed description and drawing in which:

FIG. 1 is an exploded, perspective view of a golf tee height setting apparatus according to the present invention;

FIG. 2 is a side elevational view of the golf tee height setting apparatus shown in FIG. 1 and planted in the ground; and FIG. 3 is a partially cross sectioned, side elevational view of one method of forming the golf tee height setting apparatus of the present invention.

DESCRIPTION OF THE PREFERRED EMBODIMENTS

FIGS. 1 and 2 depict a golf tee height setting apparatus 10 constructed in accordance with the teachings of the present invention.

The apparatus 10 includes a golf tee denoted generally by reference number 12 which may be formed of any suitable golf tee material, such as wood, plastic, etc. The golf tee 12 has a pointed end 14 which is insertable into the ground, and an elongated shank 16 of substantially constant cross-section which extends from the pointed end 14 to an intermediate shoulder 18 formed at a lower end of the smoothly outwardly tapering upper end 20. The shoulder 18 is defined by an annular surface on the shank 16 which extends radially and circumferentially outward from the outer surface of the constant cross-section portion of the shank 14 extending from the pointed end 14 to the shoulder 18. It will also be understood that the shoulder 18 may also be formed as a continuous radially enlarging, outwardly extending taper from an intermediate point wherein the outer diameter of the shank 16 enlarges from the one end of the constant cross section portion of the shank 16. The upper end 20 smoothly tapers outwardly from the shoulder 18 to a top end 22. The shape of the upper end 20 may be in the form of a conical taper or an enlarging concave shape as shown in FIGS. 1 and 2.

A concave or cup-shaped depression 24 is formed in the top end 22 and forms a seat for supporting a golf ball 26, shown in FIG. 2, above the ground depending on how far into the ground the pointed end 14 is pushed.

Referring briefly to FIG. 3, the substantially constant diameter shank 16 may be formed from a conventional golf tee in which the shank 16 generally tapers smoothly outwardly in diameter or cross section from the pointed end to the opposed end 22 of the tee 12.

A conventionally formed golf tee may be forcibly inserted, pointed end first, into a holder 30 shown in FIG. 3 which carries a die 32 having a central aperture 34 of a predetermined diameter. The diameter of the aperture 34 in the die 32 is selected to form the shoulder 18 at a predetermined distance from the pointed end 14 of the golf tee 12 as determined by the length of the shank 16. It would also be understood that the tee 12, when formed of wood, could be shaped on a lathe. The tee 12 could also be formed of a moldable plastic wherein the tee 12 is molded in a suitable die to the desired shape of all of the elements described above.

The remaining part of the golf tee height setting apparatus 10 of the present invention is a stopper 40 which is in the form of a planar disk having an aperture 42 preferably formed centrally therein. The diameter of the aperture 42 is substantially identical to the diameter of the shank 16; but is able to be easily slidably inserted over and removed from the shank 16.

The stopper 40 has a circular shape by example only. Other shapes, such as polygonal, i.e., square, triangular, etc., are also possible as are annularly spaced, radially extending legs, etc. Further, the outer peripheral edge of the stopper 40 extends outward a substantial distance beyond the diameter of the shoulder 18 of the golf tee 12 to prevent insertion of the tee 12 into the ground beyond the stopper 40.

The stopper 40 may be formed of any suitable material, such as plastic, wood, metal, etc., with plastic being preferred for its low cost and easy formability.

For a typical golf tee having an original shank diameter of 0.164 inches, the sizing die 32, which may be formed of a suitable high strength steel, may have a central aperture 34 with a diameter of 0.1405 inches. The stopper 40 can thus have a central aperture 42 with a diameter of 0.1406 inches to allow the stopper 40 to easily slide along the length of the shank 16 into abutment with the shoulder 18 as shown in FIG. 2.

In use, the stopper 40 is slid along the length of the shank 16 from the pointed end 14 until the stopper 40 abuts the shoulder 18. The tee 12 is then inserted pointed end 14 first into the ground as shown in FIG. 2 until the disk 40 seats firmly against the top surface of the ground. This sets a consistently repeatable height H from the top end 22 of the golf tee 12 to the ground for consistent placement of the golf ball 26 at a selected constant height.

The height of the top end 22 above the ground may be varied from tee to tee by providing different dimensions for the upper end 20 of the tee 12. For example only, the dimensions of the upper end 20 between the shoulder 18 and the top end 22 may be provided in discrete increasing length increments, i.e., 0.625 inches 0.875, 1.000, 1.125 and 1.250 inches to suit the preferences of most golfers. However, despite the varying lengths of the upper end 20, the length of the constant diameter portion from the pointed end 14 to the shoulder 18 remains constant to provide the desired repeatable height of the present inventive golf tee which like dimensioned tees are employed. Alternately, the same incremental differences may be applied to the length of the constant diameter portion between the pointed end 14 and the shoulder 18, with the length of the top end 22 remaining constant.

Since the stopper 40 may be easily slidable along the length of the shank 16 of the tee 12, the stopper 40 may be removed from the tee 12 after each use and easily stored in a golfer's pocket without consuming a significant amount of space. However, the stopper 40 can be easily reinserted over the shank 16 shown in FIG. 2 for the next tee shot.

As noted above, different golfers prefer different ball heights for a tee shot. Further, the same golfer may prefer a higher height when using a driver, an intermediate or shorter height for a three wood and an even shorter height when using a longer iron.

In view of this variability, it is possible within the scope of the present invention for a number of different golf tee height setting apparatuses to be constructed wherein the position or distance of the shoulder 18 from the pointed end 14 of the golf tee can be varied to suit the preferences of different golfers or for use with different clubs. Accordingly, according to the present invention, the golf tee height setting apparatus can include a group of similarly constructed golf tees having a reduced diameter shank 16 and a stopper disk 40 wherein the distance or position of the shoulder 18 from the pointed end 14 of each golf tee varies in any incremental fashion, such as in tenths of an inch, by example, or in varying top end 22 lengths described above. Although a single stopper disk 40 could be used with all of the different height setting golf tees, it would be preferred that the different golf tees be provided with some type of identification so as to enable the golfer to easily choose the proper tee to suit his preference or for the particular club that the golfer is using on a tee shot. Thus, each golf tee 12 having a different height shoulder 18 with respect to the pointed end 14 of the tee 12 or may be provided in a different color, again for example only.

In summary, there has been disclosed a golf tee height setting apparatus in which the ball receiving end is settable at a repeatably constant distance above the ground on each successive golf tee use.

What is claimed is:

1. A golf tee height set apparatus comprising:

a golf tee having a one piece shank with a pointed tip at one end, and an upper end extending from a single intermediate shoulder on the shank to a golf ball receiving surface at another end of the shank; and a stopper having an aperture sized to freely slidably fit over the shank into engagement with the shoulder, the stopper having a surface adapted to engage the ground when the pointed tip is inserted into the ground to repeatedly set a constant height for the ball receiving surface of the golf tee above the ground by preventing insertion of the shank into the ground beyond the surface of the stopper.

2. The golf tee height set apparatus of claim 1 wherein the stopper comprises:

a planar member having a circular aperture with diameter greater than a diameter of the portion of the shank between the pointed tip and the single intermediate shoulder and a smaller diameter hand the single intermediate shoulder.

3. The golf tee height set apparatus of claim 1 wherein the outer edge of the stopper extends radially outward beyond the diameter of the ball receiving surface of the shank.

4. The golf tee height set apparatus of claim 1 wherein the stopper is an annular disc having a circular aperture.

5. The golf tee height set apparatus of claim 1 further comprising:

the shank having a constant diameter between the pointed tip and the single intermediate shoulder, and the shank having a varying enlarging diameter from the single intermediate shoulder to the ball receiving surface.

6. A golf tee height set apparatus comprising:

a golf tee having a one piece shank with a pointed tip at one end, and an upper end extending from an intermediate shoulder on the shank to a golf ball receiving surface at another end of the shank, the shank has a lower portion formed between the pointed tip and the shoulder and an upper end carrying the ball receiving surface;

a stopper having an aperture sized to slidably fit over the shank into engagement with the shoulder, the stopper having a surface adapted to engage the ground when the pointed tip is inserted into the ground to repeatedly set a constant height for the ball receiving surface of the golf tee above the ground by preventing insertion of the shank into the ground beyond the surface of the stopper; and a plurality of like tees forming a group, each of the tees in the group having a different length of one of the lower end and the upper end.

* * * * *